US010197270B2

(12) United States Patent
Arakawa et al.

(10) Patent No.: US 10,197,270 B2
(45) Date of Patent: Feb. 5, 2019

(54) COMBUSTION BURNER FOR BOILER

(71) Applicant: MITSUBISHI HITACHI POWER SYSTEMS, LTD., Kanagawa (JP)

(72) Inventors: Yoshiaki Arakawa, Tokyo (JP); Kazuaki Hashiguchi, Tokyo (JP); Keiji Takeno, Tokyo (JP); Atsushi Yuasa, Tokyo (JP); Takahiro Jojima, Tokyo (JP); Hideta Ogawa, Kanagawa (JP); Shogo Sawa, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 69 days.

(21) Appl. No.: 15/028,793

(22) PCT Filed: Mar. 11, 2014

(86) PCT No.: PCT/JP2014/056243
§ 371 (c)(1),
(2) Date: Apr. 12, 2016

(87) PCT Pub. No.: WO2015/136609
PCT Pub. Date: Sep. 17, 2015

(65) Prior Publication Data

US 2016/0252246 A1 Sep. 1, 2016

(51) Int. Cl.
*F23D 14/24* (2006.01)
*F23D 11/24* (2006.01)
(Continued)

(52) U.S. Cl.
CPC ..... *F23D 14/24* (2013.01); *F23C 7/004* (2013.01); *F23D 11/24* (2013.01); *F23D 11/383* (2013.01);
(Continued)

(58) Field of Classification Search
CPC ..... F23C 7/004; F23D 11/24; F23D 14/24
(Continued)

(56) References Cited

U.S. PATENT DOCUMENTS 4,364,522 A 12/1982 Reider
5,365,865 A 11/1994 Monro
(Continued)

FOREIGN PATENT DOCUMENTS

CN 103363550 10/2013
CN 103542429 1/2014
(Continued)

OTHER PUBLICATIONS

Office Action dated Oct. 28, 2016 in corresponding Japanese Application No. 2016-507153, with English translation.
(Continued)

*Primary Examiner* — Avinash Savani
*Assistant Examiner* — Aaron Heyamoto
(74) *Attorney, Agent, or Firm* — Wenderoth, Lind & Ponack, L.L.P.

(57) ABSTRACT

A combustion burner for a boiler includes: an inner cylinder defining a fuel supply passage for supplying fuel; an outer cylinder surrounding the inner cylinder and defining an air supply passage between the inner cylinder and the outer cylinder; and a swirler in the air supply passage, the swirler being configured to swirl air in the air supply passage. The swirler includes a plurality of blades radially disposed between the inner cylinder and the outer cylinder, the plurality of blades extending from an air-supply side toward a combustion-space side of the air supply passage, and each of the plurality of blades having, at least on an inner cylinder side of the blade, a section with a thickness varied in a burner axial direction, the thickness being smaller at an edge
(Continued)

portion on the combustion-space side than at a maximum-thickness section of the blade.

8 Claims, 6 Drawing Sheets

(51) Int. Cl.
*F23C 7/00* (2006.01)
*F23D 11/38* (2006.01)
*F23R 3/14* (2006.01)

(52) U.S. Cl.
CPC ..... *F23R 3/14* (2013.01); *F23C 2900/06041* (2013.01)

(58) Field of Classification Search
USPC ..... 431/181, 185
See application file for complete search history.

(56) References Cited

U.S. PATENT DOCUMENTS

| | | | | |
|---|---|---|---|---|
| 6,094,916 | A | 8/2000 | Puri et al. | |
| 6,141,967 | A | 11/2000 | Angel et al. | |
| 9,518,740 | B2 * | 12/2016 | Biagioli | F23R 3/14 |
| 2003/0084667 | A1 | 5/2003 | Gerendas et al. | |
| 2006/0147854 | A1 * | 7/2006 | Fullemann | F23C 6/045 431/9 |
| 2009/0025395 | A1 | 1/2009 | Nilsson et al. | |
| 2010/0058767 | A1 * | 3/2010 | Simons | F23R 3/14 60/748 |
| 2010/0319350 | A1 * | 12/2010 | Landry | F02C 7/22 60/748 |
| 2012/0247110 | A1 | 10/2012 | Clemen | |
| 2012/0285173 | A1 | 11/2012 | Poyyapakkam et al. | |
| 2013/0255261 | A1 | 10/2013 | Abdelnabi et al. | |
| 2014/0013764 | A1 * | 1/2014 | Biagioli | F23R 3/14 60/748 |
| 2015/0104296 | A1 | 4/2015 | Yokoyama et al. | |

FOREIGN PATENT DOCUMENTS

| | | |
|---|---|---|
| JP | 44-14607 | 6/1969 |
| JP | 45-29153 | 9/1970 |
| JP | 52-48131 | 4/1977 |
| JP | 53-114631 | 9/1978 |
| JP | 55-175707 | 12/1980 |
| JP | 61-110911 | 7/1986 |
| JP | 63-311007 | 12/1988 |
| JP | 64-8035 | 1/1989 |
| JP | 7-217888 | 8/1995 |
| JP | 8-61609 | 3/1996 |
| JP | 9-119641 | 5/1997 |
| JP | 2001-41413 | 2/2001 |
| JP | 2007-285572 | 11/2007 |
| JP | 2008-510618 | 4/2008 |
| JP | 2012-237548 | 12/2012 |
| JP | 2013-181396 | 9/2013 |
| JP | 2013-213659 | 10/2013 |
| JP | 2014-16151 | 1/2014 |
| KR | 10-2014-0007766 | 1/2014 |

OTHER PUBLICATIONS

International Preliminary Report on Patentability dated Sep. 13, 2016 in corresponding International Application No. PCT/JP2014/056243.
Office Action dated Jan. 13, 2017 in corresponding Chinese Application No. 201480058833.1 (with English translation).
International Preliminary Report on Patentability dated Sep. 22, 2016 in corresponding International Application No. PCT/JP2014/056243.
International Search Report dated Apr. 15, 2014 in corresponding International Application No. PCT/JP2014/056243.
Office Action dated May 27, 2016 in corresponding Japanese Application No. 2016-507153 (with English translation).
Office Action dated Jul. 19, 2017 in Korean Patent Application No. 2016-7010793, with Machine Translation.
Office Action dated Aug. 15, 2017 in Chinese Application No. 201480058833.1, with English machine translation.
Notice of Final Rejection dated Feb. 28, 2018 in Korean Patent Application No. 2016-7010793, with English translation.

* cited by examiner

COMBUSTION BURNER FOR BOILER

TECHNICAL FIELD

The present invention relates to a combustion burner for injecting fuel and combustion air to generate a flame in a combustion space inside a boiler furnace and to combust fuel, especially to a combustion burner for a boiler, including a swirler for swirling combustion air.

BACKGROUND ART

As illustrated in FIGS. 10 and 11, a known combustion burner 80 to be mounted to a boiler furnace includes air-supply nozzles 84, 86 for supplying combustion air disposed on an outer periphery of a fuel-supply nozzle 82 for supplying fuel. Such a combustion burner 80 is often equipped with a swirler 88 disposed in an air supply passage, for securing swirl flame-holding performance.

The swirler 88 normally swirls combustion air and supplies the combustion air to a combustion space 100 of the boiler furnace, and forms a swirl flow 92 of air which a flow of fuel injected from the fuel-supply nozzle 82 in the combustion space 100 is made the center. The swirl flow 92 of air rapidly expands with a distance from the combustion burner 80, due to a centrifugal force. Thus, an inverse pressure gradient with a pressure decreasing toward the center is generated in the swirl flow 92. This inverse pressure gradient forms a flow flowing toward the center of the swirl flow 92 at a position of the swirl flow 92 away from the combustion burner 80 by a certain distance. Accordingly, combusted gas is circulated, and the high temperature of the combusted gas ignites non-combusted air-fuel mixture (fuel+air) to hold a flame.

For instance, JPH8-61609A discloses a liquid-fuel burner including an air supply passage for supplying primary air, disposed on an outer periphery of an oil-spraying nozzle, and a swirler for swirling the primary air, disposed on a distal end portion of the air supply passage.

Further, though not equipped with a swirler, JP2008-510618A (translation of a PCT application) discloses a nozzle assembly including an air-supply passage disposed on an outer periphery of a liquid-supply nozzle for supplying a liquid flow. This nozzle assembly is configured to atomize a liquid supplied by the liquid-supply nozzle and to inject the atomized liquid. In addition, the nozzle assembly is equipped with a crash pin to promote breakage of atomized liquid particles, thereby functioning to prevent accumulation of liquid around a bottom section of the crash pin.

SUMMARY

Problems to be Solved

Meanwhile, in the context of depletion of fossil fuel, it has been required in recent years to take advantage of fuels containing a flame-retardant component such as SDA pitch, which is an oil residue, and vacuum residue (VR) fuel. Such fuels cost less, which is another advantage. However, if a fuel including a flame-retardant component is to be used for the above described combustion burner, a volatile content of the fuel adhering to a swirler may become volatilized by radiation heat of a flame to produce a high-carbon residue sticking to and accumulating on the swirler. If an accumulation amount of carbon at the swirler increases, the flame may be attracted toward the swirler, which may bring about abnormal combustion of carbon and erosion of the swirler, thus resulting in a considerable decrease in the lifetime of the swirler. For instance, a swirler designed to have a useful lifetime of at least 10 years may be damaged by erosion in a year.

Conventionally, the functions required for a swirler for a combustion burner have been aimed at improving swirl flame-holding performance and flammability. Thus, erosion of a swirler has been rarely addressed. The nozzle assembly disclosed in JP2008-510618A (translation of a PCT application) merely includes a crash pin or the like for the purpose of improving fuel-spraying performance, and there is no disclosure of improvement of the lifetime of a swirler. Thus, a combustion burner capable of maintaining a flame-holding function for a long time without causing erosion of a swirler has been required.

SUMMARY

In view of this, an object of at least one embodiment of the present invention is to provide a combustion burner capable of maintaining a flame-holding function for a long time without causing erosion of a swirler even if a fuel containing a flame-retardant component is used.

Solution to the Problems

The present inventors conducted intensive researches on the mechanism of erosion of a swirler, and achieved the following findings. With reference to FIGS. 10 to 12, the mechanism of erosion of a swirler in a case in which an oil fuel is used will now be described as an example. FIG. 10 is a front view of a combustion burner, illustrating a state in which fuel is adhering to a swirler. FIG. 11 is a cross-sectional view for explaining an air flow in a conventional combustion burner. FIG. 12 is a perspective view for explaining an air flow in the vicinity of a conventional swirler.

A swirler 88 swirls air to form a swirl flow 92 in a combustion space 100. A partial air flow separates from the swirl flow 92, and the separated air flow generates a backflow 94 flowing toward the swirler 88. Particles among oil droplets sprayed by a fuel-supply nozzle 82 are transferred back by the backflow 94, thereby hitting the swirler 88 and adhering to the swirler 88. The adhering oil is heated by radiation heat of a flame, and thereby a carbon residue 90 sticks to mainly an inner peripheral side of the swirler 88, as illustrated in FIG. 10. The carbon residue 90 accumulates and blocks gaps between adjacent blades 88*a* of the swirler 88 to attract a flame, which causes heating of the adhering oil and brings about erosion of the swirler 88.

Further, the present inventors sought for a cause of separation of an air flow from the swirl flow 92, and found that the main cause is formation of a negative-pressure region 95 on an end surface of each blade 88*a* of the swirler 88 and on an end surface of the fuel-supply nozzle (inner tube) 82. That is, the negative-pressure region 95 bring about separation of an air flow from the swirl flow 92, which generates a strong backflow 94 flowing to a base portion (inner-tube side) of the blades 88*a* of the swirler 88. Due to the presence of the backflow 94, erosion of the swirler 88 takes place according to the above mechanism.

A combustion burner for a boiler, according to some embodiments, is configured to inject fuel and air to form a flame in a combustion space inside a boiler furnace, and comprises: an inner cylinder forming, at a radially-inner side, a fuel supply passage for supplying the fuel; an outer cylinder disposed so as to surround the inner cylinder and to form an air supply passage between the inner cylinder and the outer cylinder; and a swirler disposed in the air supply passage and configured to swirl the air flowing through the air supply passage. The swirler includes a plurality of blades radially disposed between the inner cylinder and the outer cylinder, the blades extending from an air-supply side toward a combustion-space side of the air supply passage, and each of the plurality of blades has, at least on an inner-cylinder side of the blade, a section with a thickness varied in a burner axial direction, the thickness being smaller at an edge portion on the combustion-space side than at a maximum-thickness section of the blade. The maximum-thickness section of the blade refers to a section with the largest thickness from an air-supply side edge portion to the combustion-space side edge portion of the blade.

In the above combustion burner, each blade of the swirler is formed to have a smaller thickness at the edge portion on the combustion-space side than at the maximum-thickness section of the blade, which makes it possible to reduce a negative-pressure region formed on an edge surface on the combustion-space side of the blade. Thus, it is possible to reduce separation of a swirl flow caused by the negative-pressure region, and to reduce generation of a backflow, which is a separated flow flowing toward the swirler. Further, it is possible to reduce adhering of fuel to the swirler, which makes it possible to prevent erosion of the swirler and to maintain a flame-holding function of the swirler for a long time.

Further, as described above, since the backflow of an air flow based on separation of the swirl flow is generated mainly at the inner-cylinder side, it is possible to securely prevent adhering of fuel to the swirler by reducing the thickness of the blade at least on the inner-cylinder side to be smaller than the thickness of the maximum thickness portion. It will be understood that the thickness may be reduced not only on the inner-cylinder side but throughout the blade from the inner-cylinder side to an outer-cylinder side.

Further, an adhering area is reduced by reducing the thickness of the blade at the combustion-space side edge portion, which is likely to have fuel adhering thereto. Thus, even if there is fuel flowing backward to the blade in the backflow starting from separation at a blade end surface, it is possible to further reduce an adhering amount of fuel to the swirler.

At least in an embodiment, each of the plurality of blades may have an inclined portion at least on a side surface on the inner-cylinder side, the inclined portion being inclined so that the thickness of the blade decreases toward the edge portion on the combustion-space side. The inclined portion is disposed on at least one of side faces of the blade.

As described above, the inclined portion is disposed on the side surface of the blade to reduce the thickness of the edge portion of the blade on the combustion-space side, which makes it possible to form a swirl flow smoothly without hampering an air flow between the blades of the swirler.

In this case, the inclined portion is disposed on both side surfaces of each of the plurality of blades, and the two inclined portions form the edge portion on the combustion-space side into a tapered shape.

A swirler is normally designed to swirl discharged air at a suitable angle to hold a flame appropriately in a boiler furnace. If an inclined portion is to be provided to reduce the thickness of the edge portion of the blade on the combustion-space side, an angle of air discharge may become out of a suitable angle range. Thus, with the inclined portion being disposed on both side surfaces of the blade, it is possible to reduce the angle of each inclined portion, which makes it possible to set an angle of air discharge within a suitable angle range. In other words, it is possible to minimize an influence of the inclined portion on an angle at which air is discharged from the swirler. Further, since it is possible to reduce the angle of each inclined portion, it is possible to avoid the risk of separation of an air flow at a taper starting position.

At least in one embodiment, each of the plurality of blades may be mounted so as to be inclined from the burner axial direction, each of the plurality of blades having a bent region bent at the air-supply side so as to have a curvature center at the air-supply side, and a linear region formed linearly at the combustion-space side, and the inclined portion being formed in the linear region.

As described above, each of the plurality of blades has a bent region bent at an upstream side being the air-supply side (air-flow direction), and a linear region at a downstream side being the combustion-space side. Thus, air having flowed into gaps between the blades has its direction changed smoothly in the bent region, and then is rectified in the linear region, which makes it possible to form a swirl flow effectively. Further, with the inclined portion being formed in the linear region, it is possible to improve machining accuracy (e.g., angle) of the inclined portion compared to a case in which the inclined portion is formed in the bent region.

In this case, the inclined portion may be inclined by an angle in a range of from 5 to 10° with respect to a blade side surface in the linear region.

In this way, it is possible to prevent separation of the swirl flow and separation of an air flow at the inclined portion. Specifically, if an inclination angle of the inclined portion is less than 5°, it is difficult to sufficiently reduce the thickness of the edge portion of the blade on the combustion-space side, and separation of a swirl flow may occur. On the other hand, if an inclination angle of the inclined portion is more than 10°, an air flow may separate at the inclined portion.

At least in one embodiment, each of the plurality of blades may have an edge surface at the edge portion on the combustion-space side, the edge surface having a thickness which secures a mechanical strength.

Here, "a thickness which secures a mechanical strength" refers to a thickness that can be maintained without being broken for a long time even if exposed to heat or an air flow from a boiler furnace.

As described above, with the combustion-space side edge portion of the blade being formed to have an end surface, it is possible to improve durability of the swirler. Further, it is more advantageous in terms of processing to have an end surface forming the combustion-space side edge portion of the blade, and durability against erosion also improves.

At least in one embodiment, each of the plurality of blades may include, at least on the inner-cylinder side, a cutout portion cutout in the burner axial direction, the cutout portion being disposed on a section facing the combustion space.

Accordingly, with the cutout portion being disposed at least on the inner-cylinder side of the blade, it is possible to reduce adhering of fuel to the blade with the cutout portion, even if there is fuel flowing backward to the blades due to the backflow starting from separation at a blade end surface.

In this case, the plurality of blades may be disposed so as to be inclined in the same direction with respect to the burner axial direction and spaced from one another in a circumferential direction of the burner. Here, an edge portion on the air-supply side of one of the blades and an edge portion on the combustion-space side of an adjacent one of the blades may be overlapped in the burner axial direction to form an overlapping region, and the cutout portion may be formed so that the overlapping region remains.

If there is a space between two adjacent blades of the swirler and the space penetrates through in the burner axial direction, the space may hamper formation of a swirl flow. Thus, with the cutout portion formed so as to maintain the overlapping region in which two adjacent blades overlap, it is possible to reduce adhering of fuel to the swirler without affecting formation of a swirl flow.

Advantageous Effects

According to at least one embodiment of the present invention, even if a fuel containing a flame-retardant component such as SDA pitch and vacuum residue (VR) fuel is used, it is possible to reduce adhering of the fuel to a swirler, and to prevent erosion of the swirler. Thus, it is possible to maintain a flame-holding function of the swirler for a long time.

DETAILED DESCRIPTION

Embodiments of the present invention will now be described with reference to the accompanying drawings. It is intended, however, that unless particularly specified, dimensions, materials, shapes, relative positions and the like of components described in the embodiments shall be interpreted as illustrative only and not intended to limit the scope of the present invention unless particularly specified.

(First Embodiment)

Figure 1:
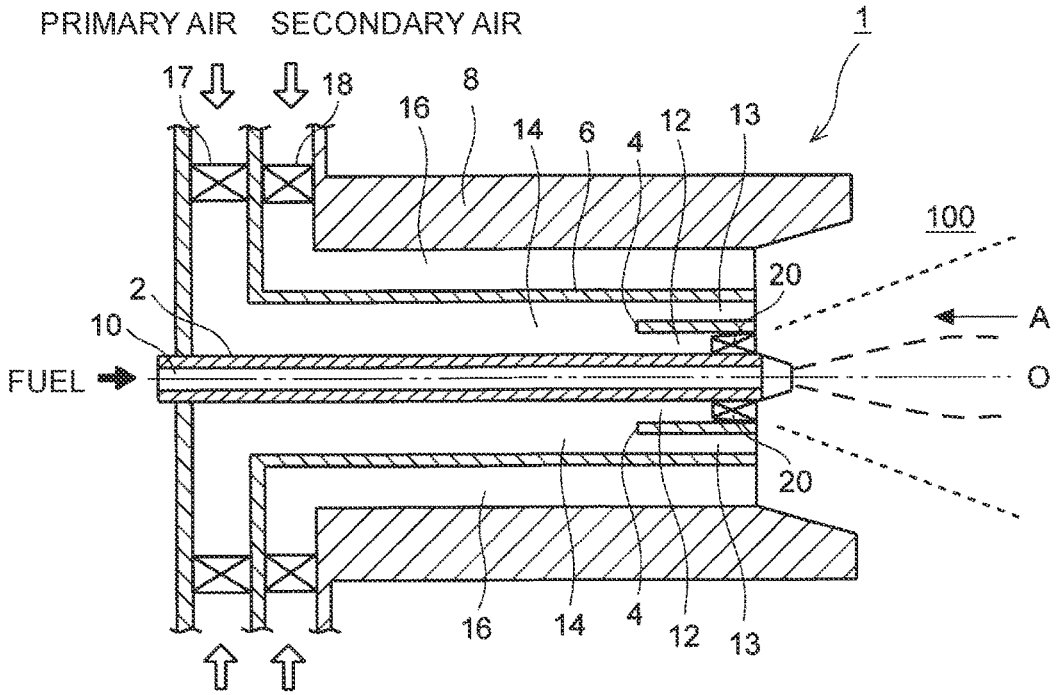
FIG. 1 is a cross-sectional view of an overall configuration of a combustion burner according to the first embodiment.
Figure 2:
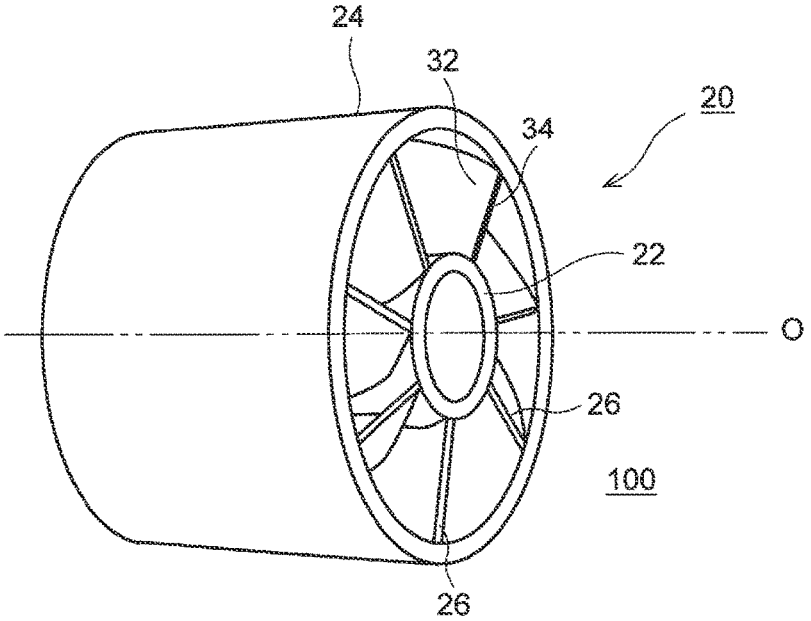
FIG. 2 is a perspective view of a swirler according to the first embodiment.
Figure 3:
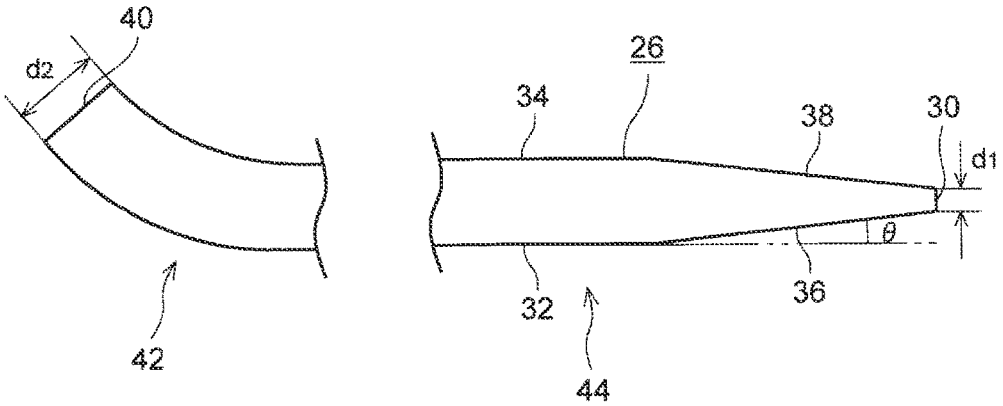
FIG. 3 is an enlarged view of a blade as seen in the radial direction of a swirler.

FIG. 1 is a cross-sectional view of an overall configuration of a combustion burner according to the first embodiment. FIG. 2 is a perspective view of a swirler according to the first embodiment. FIG. 3 is an enlarged view of a blade as seen in the radial direction of the swirler.

In an embodiment, as illustrated in FIG. 1, a combustion burner 1 includes an inner cylinder 2, an outer cylinder 4 disposed so as to surround a part of the inner cylinder 2, and a swirler 20 disposed between the inner cylinder 2 and the outer cylinder 4.

A fuel supply passage 10 is formed on the inner peripheral side of the inner cylinder 2. Fuel to be supplied to the fuel supply passage 10 is, for instance, a liquid fuel, and may be a fuel containing a flame-retardant component, such as SDA pitch and vacuum residue (VR) fuel. An end portion of the inner cylinder 2 faces a combustion space 100 of a boiler furnace.

A primary-air nozzle 6 is disposed on the outer peripheral side of the outer cylinder 4, and a secondary-air nozzle 8 is disposed on the outer peripheral side of the primary-air nozzle 6. A primary-air supply passage 14 to be supplied with primary air for combustion is disposed between the inner peripheral surface of the primary-air nozzle 6 and the outer peripheral surface of the inner cylinder 2. A secondary-air supply passage 16 to be supplied with the secondary air for combustion is disposed between the inner peripheral surface of the secondary-air nozzle 8 and the outer peripheral surface of the primary-air nozzle 6. A primary vane 17 and a secondary vane 18 are respectively disposed on the air-supply side of the primary-air supply passage 14 and the secondary-air supply passage 16. Air supply amounts to the respective air supply passages are adjusted by the above vanes 17, 18.

The outer cylinder 4 is disposed on the combustion-space 100 side of the primary-air supply passage 14, partitioning the primary-air supply passage 14 into an inner-peripheral flow path 12 and an outer-peripheral flow path 13. A part of the primary air flowing through the primary-air supply passage 14 flows into the outer-peripheral flow path 13 to be directly discharged into the combustion space 100. Another part of the primary air flows into the inner-peripheral flow path 12 to be swirled by flowing through a swirler 20 describe below, and then discharged into the combustion space 100.

The swirler 20 is disposed in the inner-peripheral flow path 12 of the primary-air supply passage 14, and swirls the primary air mainly to hold a flame. The swirler 20 extends from an air-supply side of the primary-air supply passage 14 (inner-peripheral flow path 12) toward the combustion-space 100 side. The swirler 20 may be disposed in the vicinity of an end portion of the primary-air supply passage 14 at the combustion-space 100 side. As illustrated in FIG. 2, the swirler 20 includes a plurality of blades 26 radially disposed between the inner cylinder 2 and the outer cylinder 4. As illustrated in FIG. 2, seven blades 26 are provided, for example. The swirler 20 may be an integrated piece including a swirler inner cylinder 22 corresponding to the inner cylinder 2, a swirler outer cylinder 24 corresponding to the outer cylinder 4, and blades 26 mounted between the swirler inner cylinder 22 and the swirler outer cylinder 24. In this case, the swirler 20 is fixed by being fitted between the inner cylinder 2 and the outer cylinder 4.

In an embodiment, the blades 26 are inclined in the same direction from the burner axial direction O, and spaced from one another in the circumferential direction of the burner 1. As illustrated in FIG. 3, each blade 26 has a bent region 42 bent at an upstream side (the air-supply side) in the air-flow direction, and a linear region 44 formed linearly at a downstream side (the combustion-space 100 side). Further, a side surface 32 of the swirler 20 faces the combustion space 100 at an angle (see FIGS. 2 and 4). In this way, air having flowed into gaps between the blades 26 of the swirler 20 swirls due to inclination of the blades 26, thereby forming a swirl flow of air in the combustion space 100. Further, the bent region 42 is bent so as to have a curvature center at the air-supply side relative to the blades 26. Air having flowed into a gap between an adjacent two of the blades 26 has its direction changed in the bent region 42, and is rectified in the linear region 44 to be injected into the combustion space 100, which makes it possible to form a swirl flow effectively in the combustion space 100.

Further, the present embodiment includes the following configuration to restrict a backflow toward the swirler 20 due to separation of the swirl flow of air.

As illustrated in FIG. 3, each blade 26 of the swirler 20 has, at least on the inner-cylinder 2 (swirler inner cylinder 22) side, a section with a thickness varied in the burner axial direction O. Further, each blade 26 is formed such that, at least on the inner-cylinder 2 (swirler inner cylinder 22) side, the thickness $d_1$ of a combustion-space side edge portion 30 is smaller than the thickness $d_2$ of a maximum-thickness section of the blade 26. It will be understood that the above configuration may be applied not only to the inner-cylinder 2 side but also to the thickness of the blade 26 from the inner cylinder 2 to the outer cylinder 4. The maximum-thickness section of the blade 26 refers to a section with the largest thickness from an air-supply side edge portion 40 to the combustion-space side edge portion 30 of the blade 26. In FIG. 3, the thickness of the air-supply side edge portion 40 is shown as the thickness of the maximum thickness section. However, the maximum thickness section is not limited to this portion, and may be another portion such as a central portion with respect to the burner axial direction O, for instance.

In an embodiment, an inclined portion 36 (or 38) may be disposed on at least one (32 or 34) of the side surfaces 32, 34 at least on the inner-cylinder 2 (swirler inner cylinder 22) side, the inclined portion 36 (or 38) being oblique so that the thickness decreases toward the combustion-space side edge portion 30.

In this case, the inclined portions 36, 38 may be disposed respectively on both of the side surfaces 32, 34 of the blade 26 so that the pair of inclined portions 36, 38 forms the combustion-space side edge portion 30 into a tapered shape.

Figure 4:
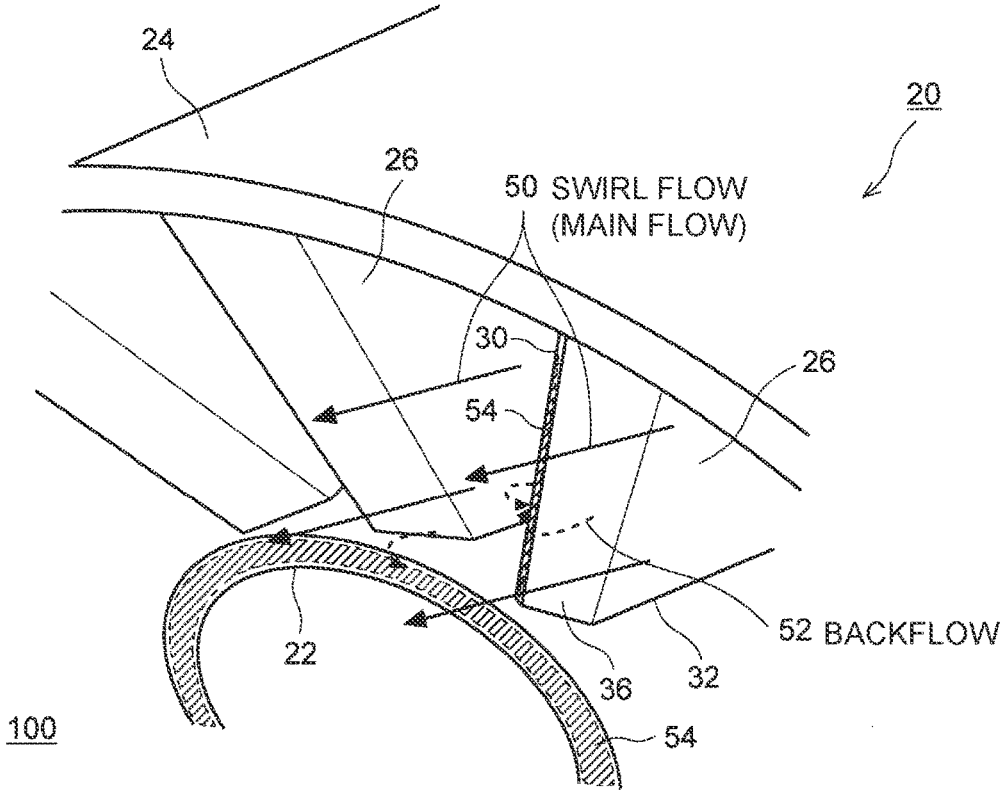
FIG. 4 is a perspective view for explaining an air flow in the vicinity of the swirler according to the first embodiment.

As described above, according to the present embodiment, the blade 26 of the swirler 20 is formed such that, the thickness $d_1$ of the combustion-space side edge portion 30 is smaller than the thickness $d_2$ of the maximum-thickness section of the blade 26, which makes it possible to reduce the area of a negative-pressure region 54 formed on a combustion-space side end surface of the blade 26, as illustrated in FIG. 4. Thus, it is possible to reduce separation of a swirl flow 50 caused by the negative-pressure region 54, and to reduce generation of a backflow 52, which is a separated flow flowing toward the swirler 20. In this way, it is possible to reduce adhering of fuel to the swirler 20, which makes it possible to prevent erosion of the swirler 20 and to maintain a flame-holding function of the swirler 20 for a long time. FIG. 4 is a perspective diagram for explaining an air flow in the vicinity of the swirler according to the first embodiment.

Further, since the backflow 52 of an air flow based on separation of the swirl flow 50 is generated mainly at the inner-cylinder 2 (swirler inner cylinder 22) side, it is possible to securely prevent adhering of fuel to the swirler 20 by reducing the thickness of the blade 26 at least on the inner-cylinder 2 side.

Further, an adhering area is reduced by reducing the thickness of the blade 26 at the combustion-space side edge portion 30, which is likely to have fuel adhering thereto. Thus, even if there is fuel flowing backward to the blade 26 in the backflow 52 starting from separation at a blade end surface, it is possible to further reduce an adhering amount of fuel to the swirler 20.

Further, in the above embodiment, as illustrated in FIG. 3, the inclined portions 36, 38 may be formed in the linear region 44 of the blade 26. As described above, with the inclined portions 36, 38 being formed in the linear region 44, it is possible to improve machining accuracy (e.g., angle) of the inclined portions 36, 38 as compared to a case in which the inclined portions 36, 38 are formed in the bent region 42.

In this case, the inclined portions 36, 38 may have an obliquity angle of θ in a range of from 5 to 10° with respect to the side surfaces 32, 34 of the linear region 44. In this way, it is possible to prevent separation of the swirl flow and separation of an air flow at the inclined portions 36, 38.

Further, the combustion-space side edge portion 30 of the blade 26 may have an end surface with the thickness $d_1$, which secures a mechanical strength. As described above, with the combustion-space side edge portion 30 of the blade 26 being formed to have an end surface, it is possible to improve durability of the swirler 20. Further, it is more advantageous in terms of processing to have an end surface forming the combustion-space side edge portion 30 of the blade 26, and durability against erosion also improves.

(Second Embodiment)

Figure 5:
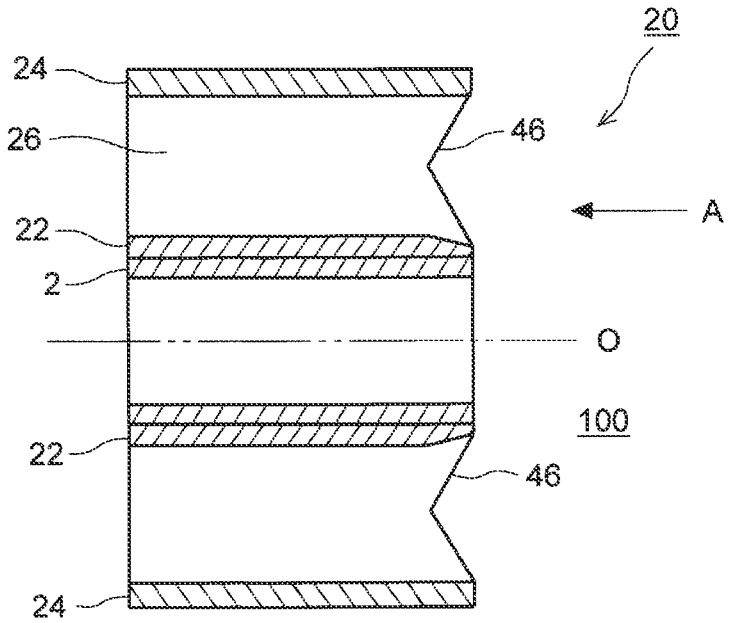
FIG. 5 is a cross-sectional view of a swirler according to the second embodiment.
Figure 6:
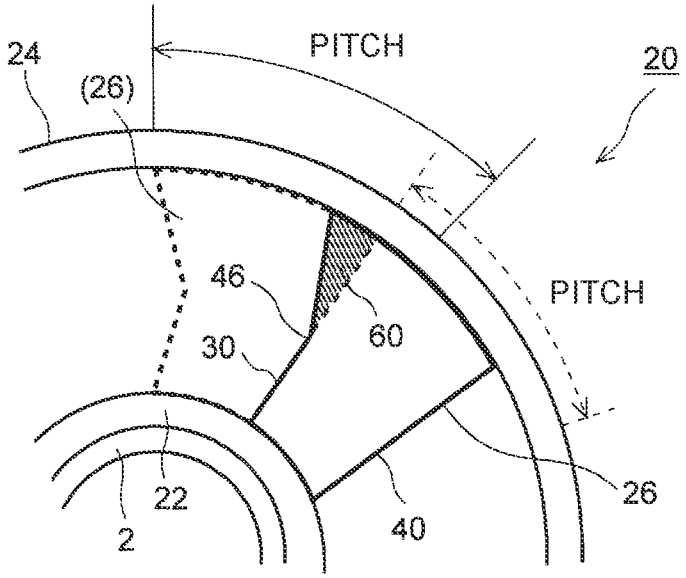
FIG. 6 as a view of the swirler in FIG. 5 seen from direction A.

With reference to FIGS. 5 and 6, a combustion burner according to the second embodiment of the present invention will be described. It is possible to extend the lifetime of a swirler even further by employing the present embodiment in combination with the first embodiment. FIG. 5 is a cross-sectional view of a swirler according to the second embodiment, and FIG. 6 is a view of the swirler in FIG. 5 seen from direction A.

The present embodiment has the following configuration to reduce adhering of fuel even if there is fuel flowing backward to blades due to a backflow starting from separation at a blade end surface of the swirler 20.

As illustrated in FIGS. 5 and 6, the blade 26 has a cutout portion 46 cut out in the burner axial direction O at a section facing the combustion space 100, at least on the inner-cylinder 2 (swirler inner cylinder 22) side. For instance, the cutout portion 46 has a shape such that the cutout width is the largest at the center part in the radial direction, and the cutout width decreases toward the opposite ends, as seen from a side surface of the blade 26. The shape of the cutout portion 46 is not limited to this.

Figure 7:
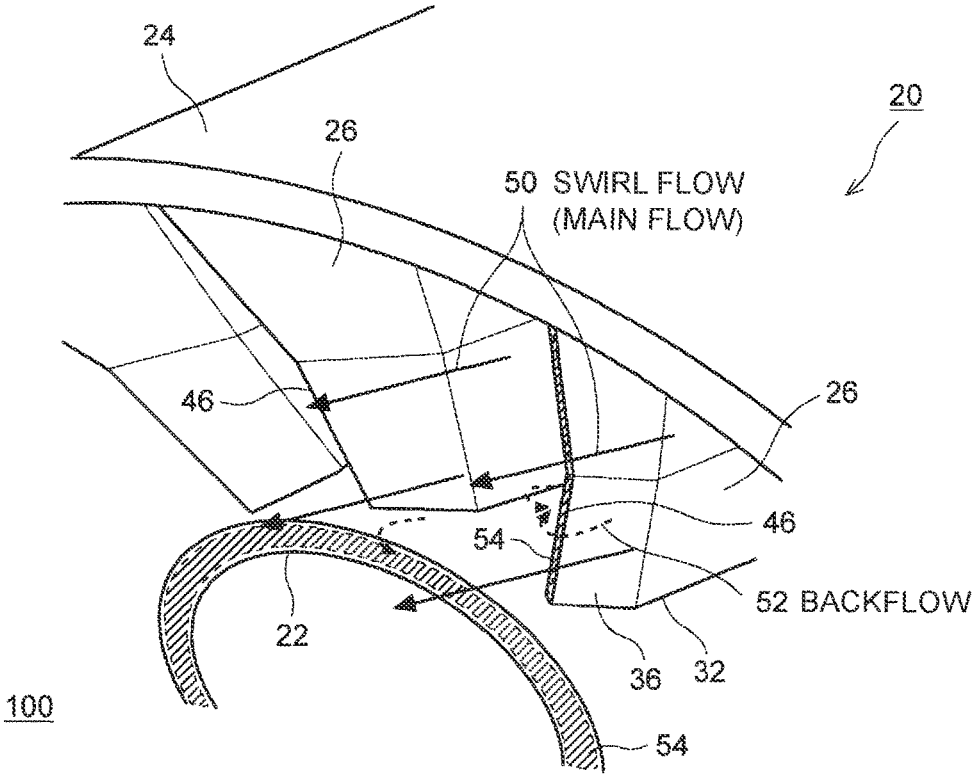
FIG. 7 is a cross-sectional view for explaining an air flow in the vicinity of the swirler according to the second embodiment.

FIG. 7 is a cross-sectional view for explaining an air flow in the vicinity of the swirler according to the second embodiment.

As described above, according to the present embodiment, with the cutout portion 46 being disposed at least on the inner-cylinder 2 (swirler inner cylinder 22) side of the blade 26, it is possible to restrict adhering of fuel to the blade 26 with the cutout portion 46, even if there is fuel flowing backward to blades due to the backflow 52 starting from separation at a blade end surface.

Further, as illustrated in FIGS. 5 and 6, if the blades 26 are disposed so as to be inclined in the same direction from the burner axial direction O and spaced from one another in the circumferential direction of the burner as described above, with the air-supply side edge portion 40 of a blade and the combustion-space side edge portion 30 of an adjacent blade being overlapped in the burner axial direction O, the cutout portion 46 may be formed so as to maintain this overlapping region 60.

If there is a space between two adjacent blades 26 of the swirler 20 and the space penetrates through in the axial direction O of the burner 1, the space may hamper formation of a swirl flow. Thus, with the cutout portion 46 formed so as to maintain the overlapping region 60 in which two adjacent blades 26 overlap with each other, it is possible to reduce adhering of fuel to the swirler 20 without affecting formation of a swirl flow.

Figure 8:
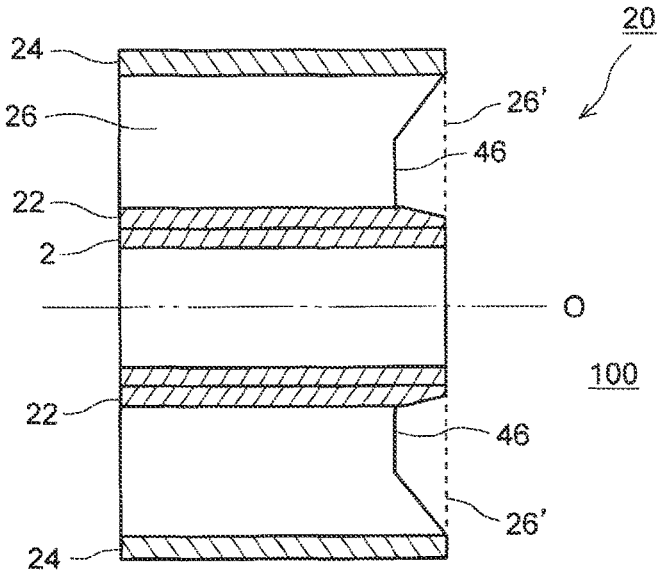
FIG. 8 is a cross-sectional view of a swirler according to a modified example of the second embodiment.
Figure 9:
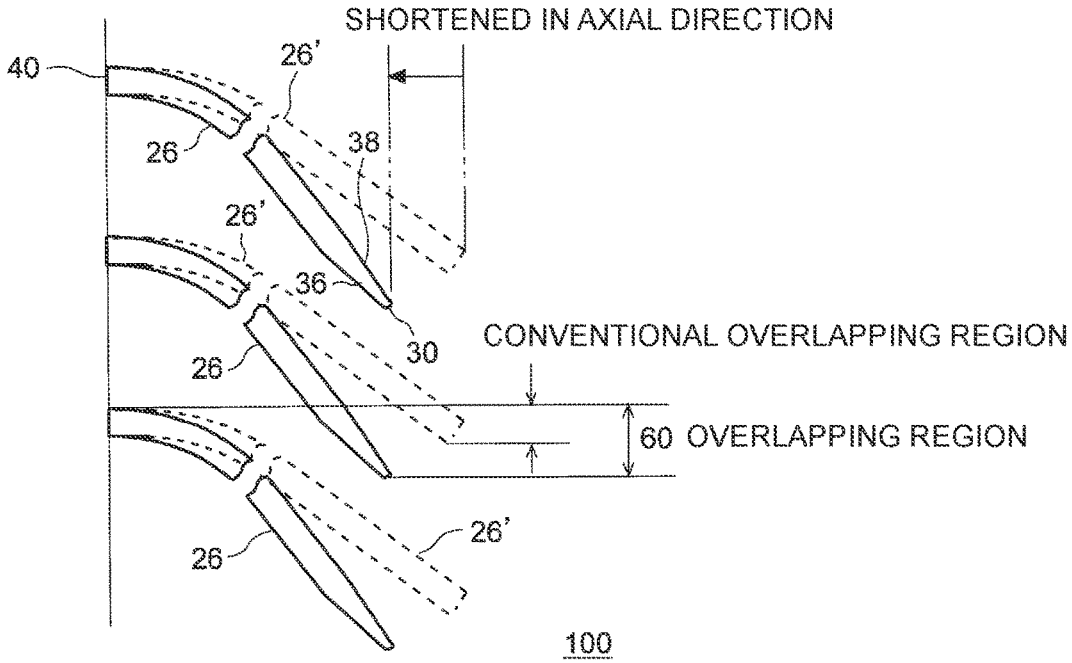
FIG. 9 is an expansion view of blades of the swirler in FIG. 8, expanded in the circumferential direction.
Figure 10:
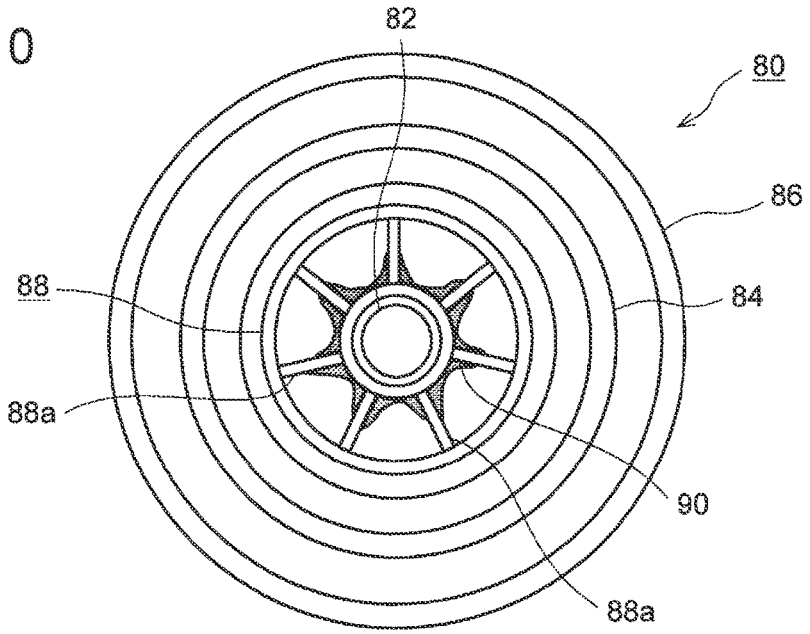
FIG. 10 is a front view of a combustion burner, illustrating a state in which fuel is adhering to the swirler.
Figure 11:
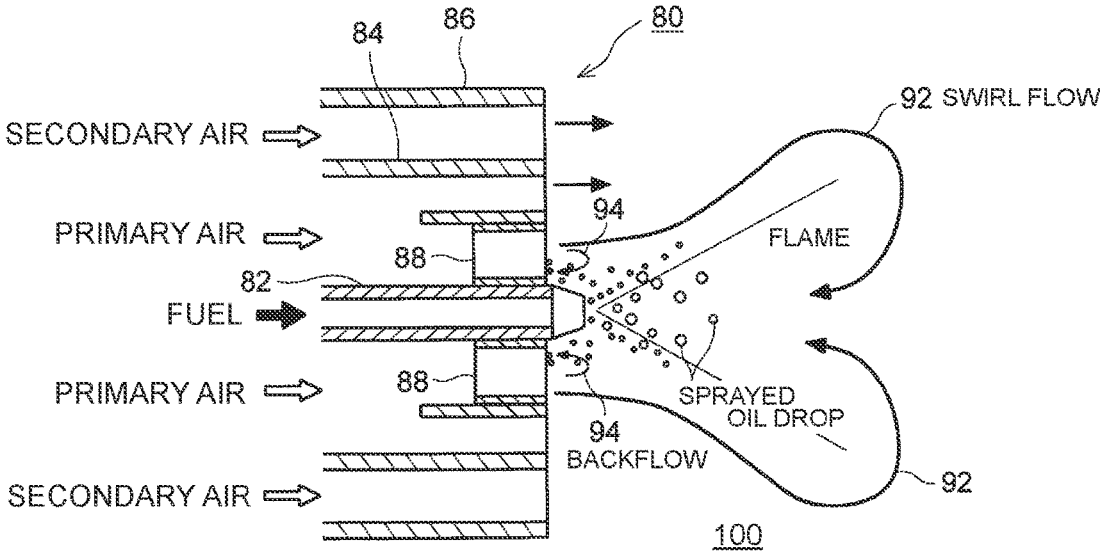
FIG. 11 is a cross-sectional view for explaining an air flow in a conventional combustion burner.
Figure 12:
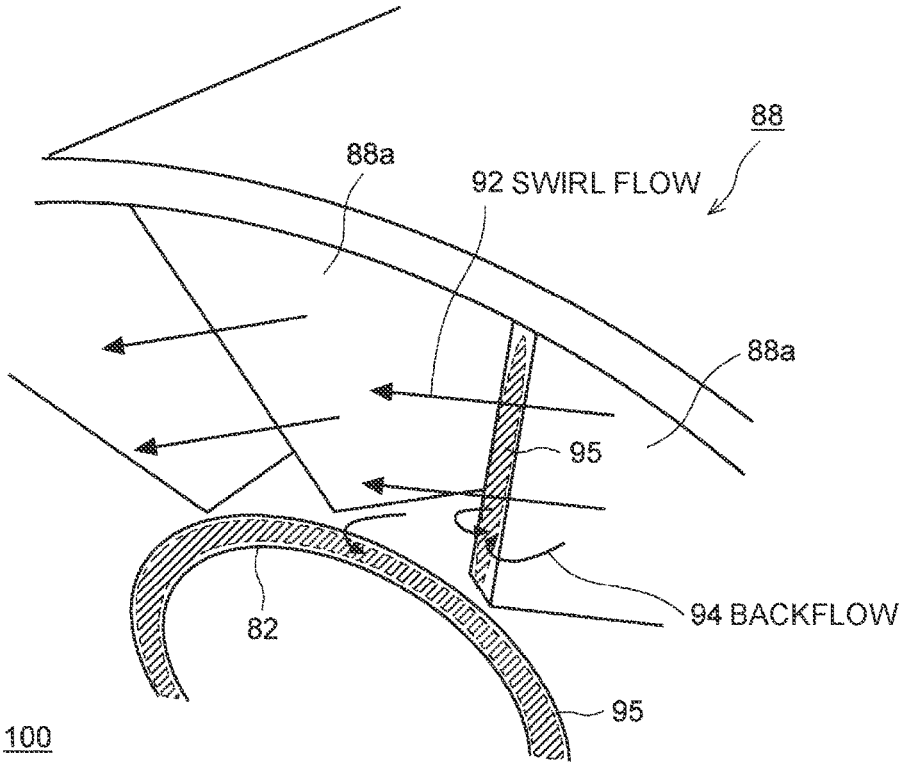
FIG. 12 is a perspective view for explaining an air flow in the vicinity of a conventional swirler.

With reference to FIGS. 8 and 9, a modified example of the second embodiment will be described. FIG. 8 is a cross-sectional view of a swirler according to a modified example of the second embodiment, and FIG. 9 is an expansion view of blades of the swirler in FIG. 8, expanded in the circumferential direction. In the drawings, dotted lines represent an outer-shell shape of conventional blades 26'.

As illustrated in FIGS. 8 and 9, while the pitch of the blades 26 is maintained to be the same as that of the conventional blades 26', the length of each blade 26 in the burner axial direction O is shorter than that of the conventional blades 26', and the length of each blade 26 in the radial direction is longer. In this way, the overlapping region 60 of adjacent two of the blades 26 expands, which makes it possible to increase a region in which the cutout portion 48 can be formed. For instance, the cutout portion 48 has a shape such that the cutout width is constant from the center part in the radial direction to the swirler inner cylinder 22 side, and the cutout width decreases from the center part toward the swirler outer cylinder 24 side, as seen from a side surface of the blade 26.

Embodiments of the present invention were described in detail above, but the present invention is not limited thereto, and various amendments and modifications may be implemented within a scope that does not depart from the present invention.

DESCRIPTION OF REFERENCE NUMERALS

1 Combustion burner
2 Inner cylinder
4 Outer cylinder
6 Primary-air nozzle
8 Secondary-air nozzle
10 Fuel supply passage
12 Inner-peripheral flow path
13 Outer-peripheral flow path
14 Primary-air supply passage
16 Secondary-air supply passage
17 Primary vane
18 Secondary vane
20 Swirler
22 Swirler inner cylinder
24 Swirler outer cylinder
26 Blade
30 Combustion-space side edge portion
32, 34 Side surface
36, 38 Inclined portion
40 Air-supply side edge portion
42 Bent region
46, 48 Cutout portion
50 Swirl flow
42 Backflow
54 Negative-pressure region
100 Combustion space

The invention claimed is:

1. A combustion burner comprising:

an inner cylinder defining, at a radially-inner side, a fuel supply passage for supplying fuel;

an outer cylinder surrounding the inner cylinder and defining an air supply passage between the inner cylinder and the outer cylinder; and a swirler in the air supply passage, the swirler being configured to swirl air in the air supply passage, wherein the swirler includes a plurality of blades radially disposed between the inner cylinder and the outer cylinder, the plurality of blades extending from a leading edge on an air-supply side toward a trailing edge on a combustion-space side of the air supply passage, wherein the trailing edge of each of the plurality of blades includes a cutout portion positioned at least on an inner cylinder side such that the trailing edge at the cutout portion recedes from the combustion-space side upstream in a burner axial direction, wherein each of the plurality of blades has, at least on the inner cylinder side of the blade, a section with a thickness varied in the burner axial direction, the thickness being smaller at the trailing edge on the combustion-space side including the cutout portion than at a maximum-thickness section of the blade, and wherein, for each of the plurality of blades, the cutout portion is defined such that a cutout width increases from an outer cylinder side toward a center part in a radial direction, as seen from a side surface of the blade.

2. The combustion burner for a boiler according to claim 1, wherein the side surface is a first side surface and each of the plurality of blades has a second side surface, and the first side surface or the second side surface includes an inclined portion at least on the inner cylinder side, the inclined portion being inclined so that the thickness of the blade decreases toward the trailing edge on the combustion-space side.

3. The combustion burner for a boiler according to claim 2, wherein the inclined portion is a first inclined portion, the first side surface includes the first inclined portion, the second side surface includes a second inclined portion corresponding to the first inclined portion, and the first inclined portion and the second inclined portion define the trailing edge on the combustion-space side into a tapered shape.

4. The combustion burner for a boiler according to claim 1, wherein the side surface is a first side surface and each of the plurality of blades has a second side surface, and the first side surface or the second side surface includes an inclined portion at least on the inner cylinder side, the inclined portion being inclined so that the thickness of the blade decreases toward the trailing edge on the combustion-space side, wherein each of the plurality of blades is inclined from the burner axial direction, wherein each of the plurality of blades has a bent region bent at the air-supply side so as to have a curvature center at the air-supply side, and a linear region defined linearly at the combustion-space side, and wherein the linear region includes a first portion having a constant thickness, and a second portion which is positioned on a downstream side of the first portion and at which the first side surface or the second side surface includes the inclined portion such that the thickness of the blade decreases toward the trailing edge.

5. The combustion burner for a boiler according to claim 4, wherein the inclined portion is inclined by an angle in a range of from 5 to 10° with respect to a portion of the first side surface or the second side surface other than the inclined portion, in the linear region.

6. The combustion burner for a boiler according to claim 1, wherein a first part of the trailing edge at an outer circumferential surface of the inner cylinder is positioned further upstream than a second part of the trailing edge at an inner circumferential surface of the outer cylinder.

7. The combustion burner for a boiler according to claim 6, wherein the plurality of blades is inclined in the same direction with respect to the burner axial direction and spaced from one another in a burner circumferential direction, the leading edge on the air-supply side of a first of the plurality of blades and the trailing edge on the combustion-space side of a second of the plurality of blades being overlapped in the burner axial direction to define an overlapping region, wherein the first of the plurality of blades is adjacent to the second of the plurality of blades, and wherein the cutout portion is defined such that the overlapping region remains.

8. The combustion burner for a boiler according to claim 1, wherein, for each of the plurality of blades, the leading edge extends radially as seen from the side surface of the blade.

* * * * *